US006565485B1

(12) United States Patent
Kinsella

(10) Patent No.: US 6,565,485 B1
(45) Date of Patent: May 20, 2003

(54) EXERCISE HANDGRIP APPARATUS

(76) Inventor: David Kinsella, 117 Medalist, Austin, TX (US) 78734

( * ) Notice: Subject to any disclaimer, the term of this patent is extended or adjusted under 35 U.S.C. 154(b) by 0 days.

(21) Appl. No.: 09/717,168

(22) Filed: Nov. 20, 2000

(51) Int. Cl.[7] ..... A63B 23/16
(52) U.S. Cl. ..... 482/49; 482/148
(58) Field of Search ..... 482/44, 45, 49; D09/300–574

(56) References Cited

U.S. PATENT DOCUMENTS

| | | | | | |
|---|---|---|---|---|---|
| 2,848,234 | A | | 8/1958 | Brandon et al. | 273/35 |
| 4,093,211 | A | | 6/1978 | Hughes et al. | 272/68 |
| 4,106,315 | A | | 8/1978 | Dohanyos | 428/68 |
| 4,513,962 | A | | 4/1985 | Robson et al. | 272/68 |
| 4,715,633 | A | * | 12/1987 | Brink et al. | 294/31.2 |
| 4,798,377 | A | * | 1/1989 | White | 272/67 |
| 4,799,668 | A | | 1/1989 | Jansen | 272/73 |
| D326,127 | S | | 5/1992 | Rink | D21/198 |
| 5,681,243 | A | | 10/1997 | Criss | 482/49 |
| 5,722,117 | A | | 3/1998 | Nielsen | 16/114 |
| 5,797,165 | A | | 8/1998 | Armbrust | 16/114 |
| D403,035 | S | | 12/1998 | MacPherson | D8/303 |
| 6,047,976 | A | * | 4/2000 | Wang | 280/47.315 |
| D431,060 | S | * | 9/2000 | Wyrick | D21/684 |
| 6,122,800 | A | * | 9/2000 | Cheng | 16/113.1 |
| 6,196,122 | B1 | * | 3/2001 | Lai | 99/495 |

* cited by examiner

*Primary Examiner*—Nicholas D. Lucchesi
*Assistant Examiner*—Lori Baker Amerson
(74) *Attorney, Agent, or Firm*—Thompson & Knight, LLP; Aaron A. Weiss

(57) ABSTRACT

An integrated hand exercise device with a hand-held container or a hand-carried object such as a briefcase, handbag, umbrella or a walker-cane is provided. The integrated hand grip exercise device generally includes a handgrip exerciser combined with a handle of the hand-held container or hand-carried object. Such combination oft he handgrip exerciser with the handle permits the hand exercise device to be operated as the briefcase, handbag or umbrella is being used by a user. The handgrip exerciser generally includes one or more springs and a handlebar for interposing a desired resistance or compressible tension between the handle and the handlebar for exercising hands, wrists and arms. Alternatively, a squeezable resilient member may provide a desired resistance or compressible tension. The integrated hand exercise device may be detachable from the hand-held container or hand-carried object, and the resistance or compressible tension maybe user-selectable.

23 Claims, 5 Drawing Sheets

FIG. 1
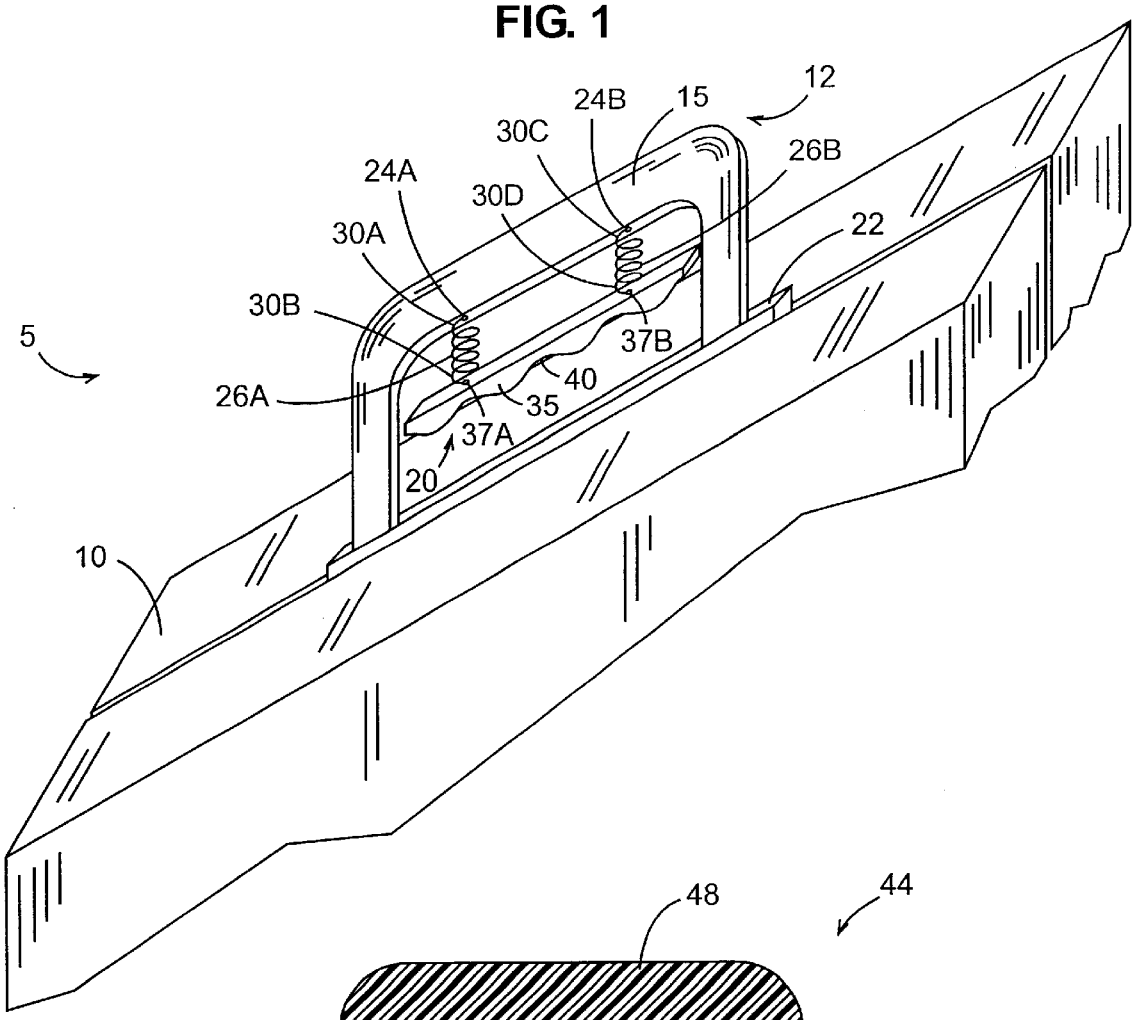
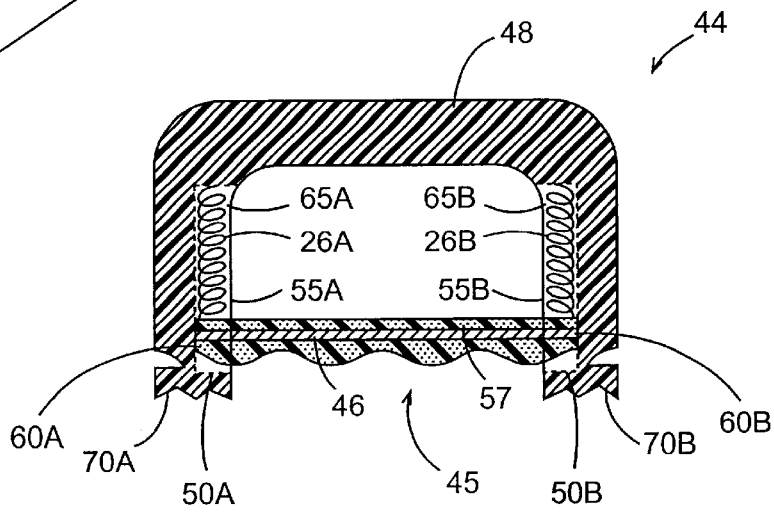
FIG. 2B

FIG. 3A
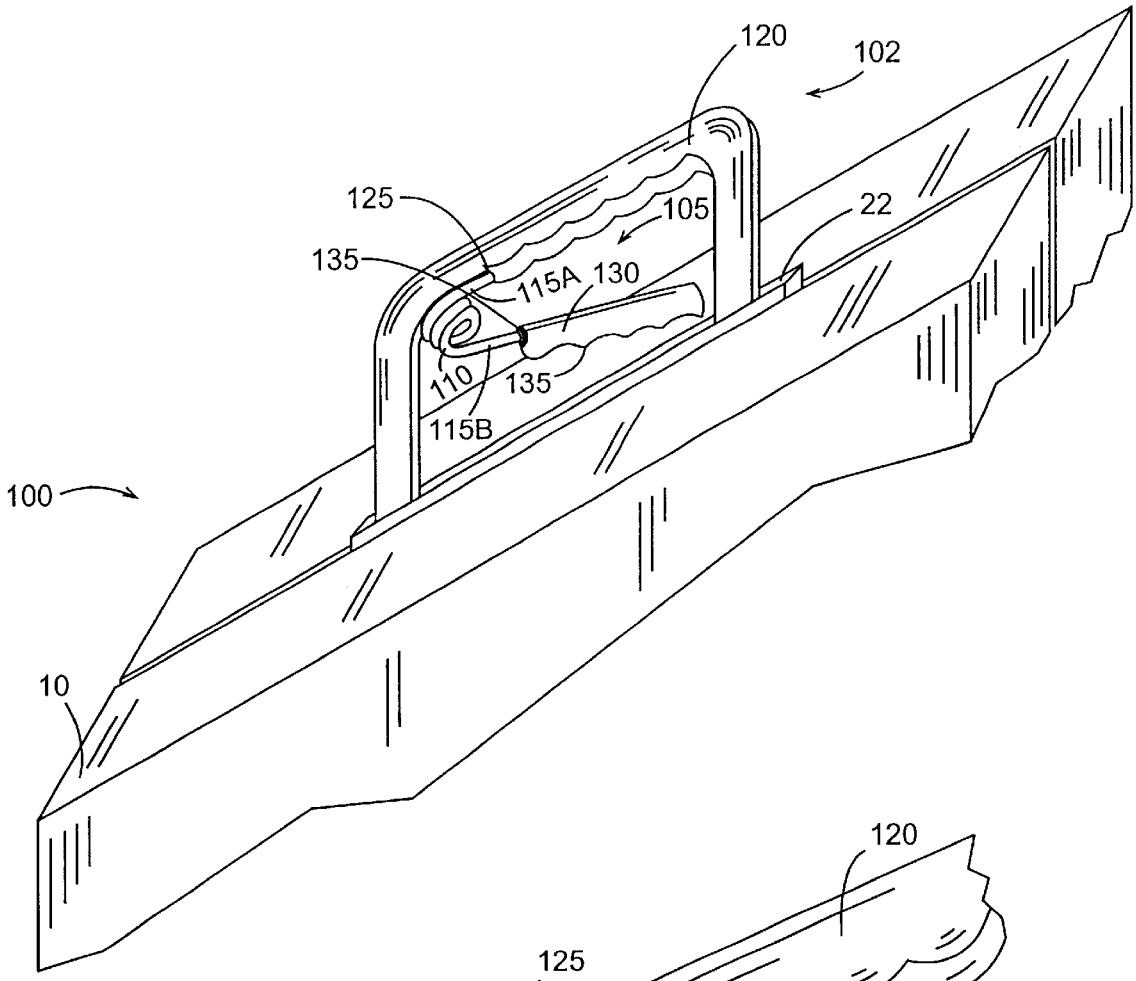
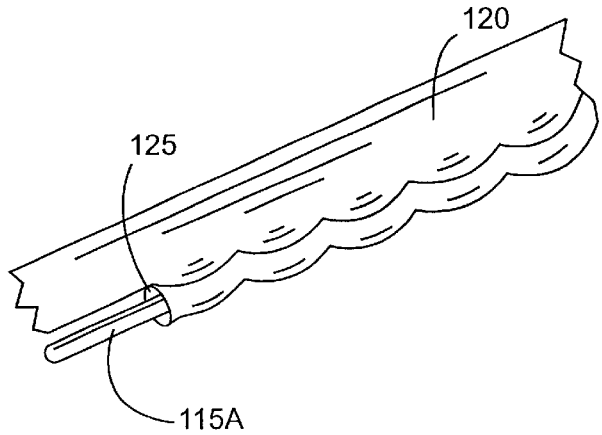
FIG. 3B

FIG. 4A
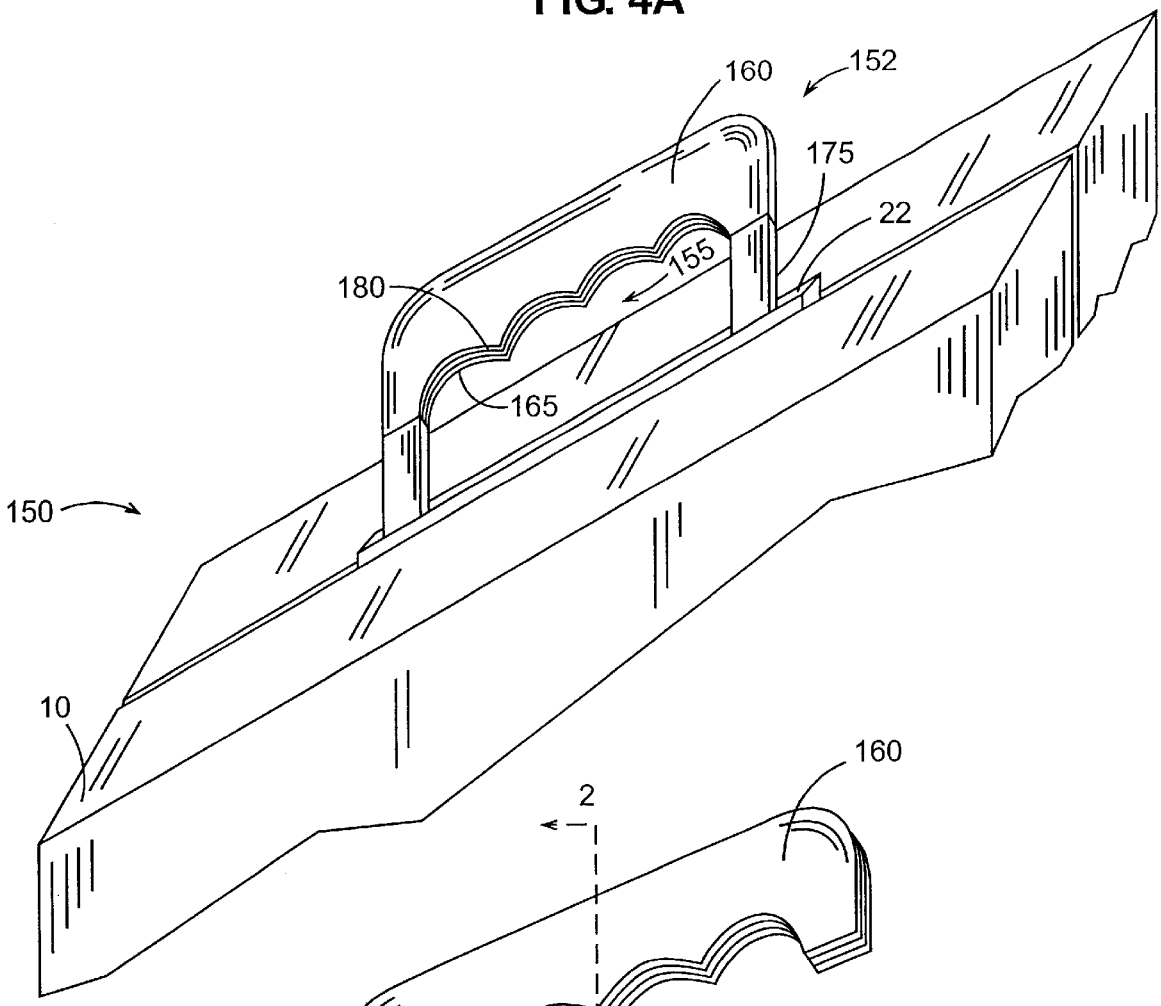
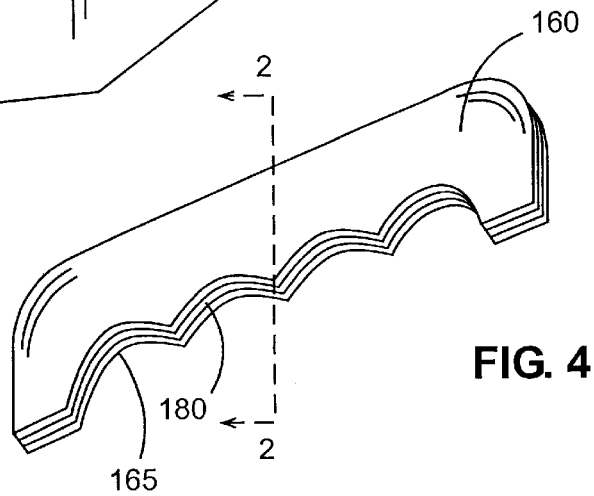
FIG. 4B
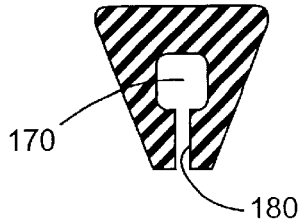
FIG. 4C

EXERCISE HANDGRIP APPARATUS

TECHNICAL FIELD OF THE INVENTION

The present invention relates to the field of hand exercising devices and in particular, to a squeezable hand exercise device integrated with a handle or other device.

BACKGROUND OF THE INVENTION

A variety of hand exercise devices have been developed for individuals to exercise and strengthen the gripping ability of the hand. Such devices include squeezable rubber balls, foam rubber pads, and handles interconnected with a coiled spring. While these exercising devices for hands, wrists and arms have proven effective for stimulating and strengthening the muscles of the hand and forearm, these devices are designed to be independently gripped in the hand. That is, an individual cannot use these devices and concurrently perform another activity, such as carrying and/or manipulating another object with the same hand.

Some prior art attempts have been made to devise hand exercise devices to provide a user a means for exercising hands concurrently with another activity such as driving. Unfortunately, many previously-known attempts have substantial limitations and restrictions. These limitations and restrictions reduce opportunities for the usage of such hand exercise devices for exercising muscles of hands and arms including handgrips, forearms, and wrists.

One such hand exercise device is disclosed in U. S. Pat. No. 4,798,377 to White. The White patent discloses a bicycle handlebar grip exerciser. The bicycle handlebar grip exerciser is attached to a bicycle handlebar where the rider of the bicycle may squeeze the bicycle handlebar grip exerciser toward the handlebar while riding as a form of exercising the hand. However, such a hand exercise device requires operating the bicycle for exercising the hands, which limits a user's ability to realize any hand exercise benefit only to the period of operation of the bicycle.

U.S. Pat. No. 5,681,243 to Criss discloses a hand exercise device for exercising an individual's hand and forearm while grasping an object, such as a steering wheel. The disclosed hand exercise device comprises a compressible resilient body member. However, with the exercise device mounted on the steering wheel, the exercising of the hand and forearm can only occur when the steering wheel is grasped. In addition, the compressible resilient body member of this exercise device is of fixed dimension and requires to be movably affixed on the object so as to permit an individual to manipulate the object and exercise the hands concurrently. Thus, this exercise device is unsuitable for use with objects having dimensions that do not allow proper frictional engagement of the resilient body member to the object. Further, the requirement of sliding movement of the resilient body member in a non-compressed condition along the object may render it unsuitable for use with different objects.

While these hand exercise devices can provide ability for exercising muscles of hands and arms with certain limited forms of concurrent activity, these solutions have unfortunately involved utilizing special objects and situations that involve specific activities having substantial limitations and severe restrictions. Consequently, they are unusable for concurrently exercising muscles of a hand and arm including handgrip, forearm, and wrist when holding or carrying a container member while walking. A variety of container members that are configured for carrying by hand have built-in handles associated therewith. For example, a container member such as a luggage bag, a hand-bag or purse, a briefcase, a duffle-bag, a satchel or any other similar item generally have a handle. While carrying or holding a container member, such as a briefcase, it is often desirable to have the ability to exercise one's hand or handgrip. Likewise, objects such as umbrellas, canes, and walkers include a handle, and it would be desirable to be able to exercise one's grip while holding its handle.

Accordingly, what is needed in the art is a convenient, effective solution for concurrently exercising one's hand or handgrip while carrying or holding an object in the hand.

SUMMARY OF THE INVENTION

An object of the present invention is therefore to provide methods and apparatus for an exercising container or object. According to one embodiment of the invention, an exercising handbag may include a container member, a handle coupled to the container member, and a handgrip exerciser integral with the handle. As an example, the exercising handbag could be a briefcase, purse, or suitcase. The handle may include first and second apertures, and the handgrip exerciser may include first and second springs, each spring having first and second ends extended longitudinally for coupling the first ends of the first and second springs to the handle through the first and second apertures. In addition, the exercising handbag may include a handlebar having third and fourth apertures for coupling the second ends of the first and second springs, respectively.

In an exemplary embodiment, the handlebar may include finger receiving portions along the bottom surface thereof. Moreover, the first and second springs may be replaceable and may have a selectable strength of spring rates including a first and second spring rate such that the first spring rate may be lower in strength than the second spring rate.

In another embodiment, a handgrip exerciser may include a coil spring having first and second ends extended longitudinally, the first end being coupled to the handle through a first aperture in the handle. Included may be a handlebar comprising a second aperture for coupling the second end of the coil spring, and the handlebar may have finger receiving portions along the bottom surface. Additionally, the coil spring can be of a selectable strength of spring rates including a first and second spring rate such that the first spring rate may be lower in strength than the second spring rate.

In an alternate embodiment, a handgrip exerciser may include a resilient member disposed onto a handle and dimensioned to be gripped with a hand to grab the handle for carrying a container member. For example, the resilient member could be squeezable material, the squeezable material inducing the resilient member to compress when squeezed and expand when released. The handle may be detachable from the container member.

The exercising handbag may further include a cooperating flange and groove assembly for attaching the handle to the container member through the cooperating flange and the groove assembly. The handle may include first and second notches disposed proximal to first and second distal ends of the handle, respectively. And the container member may include first and second handle receiving grooves each having an associated integrally formed spring loaded flange for interlocking the handle securely therewith.

In accordance with one aspect of the present invention, a handle exercise grip attachable to a container member includes a removable handle and a hand exercise device including a handlebar, the hand exercise device integrated with the removable handle. The hand exercise device may include a compression device for interposing compressible tension between the removable handle and the handlebar. The hand exercise device is generally provided for exercising a hand while holding the removable handle. The removable handle is configured for manipulating by hand, and the hand exercise device is squeezable for exercising a hand while concurrently operating the container member. The compression device may include first and second springs with each spring having associated first and second spring chambers extended longitudinally for receiving the first and second springs within the removable handle through first and second recesses. It may also include an elongated handlebar having first and second abutments for coupling to the removable handle through the first and second recesses. The first and second springs each may have a selectable strength of spring rates including a first and second spring rate such that the first spring rate could be lower in strength than the second spring rate.

In accordance with one aspect of the present invention, a method for providing an exercise handgrip with a handbag may include integrating a hand exercise device with a handle of the handbag.

In accordance with one aspect of the present invention, a handgrip assembly attachable to a hand-held container or a hand-carried object such as a briefcase, handbag or an umbrella may include a handle, a handgrip exerciser, and a compression device for interposing compressible tension between the handle and handgrip exerciser.

In accordance with one aspect of the present invention, a hand-held container or a hand-carried object such as a briefcase, handbag or an umbrella includes a combined exercise handgrip. The combined exercise handgrip may include a handle, a handgrip exerciser, and a compression device for interposing compressible tension between the handle and handgrip exerciser.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 1 is a perspective view of an embodiment of a combined exercise handgrip with a briefcase in accordance with the present invention.

FIG. 2B is a cross-sectional view of an integrated exercise handgrip device consistent with the present invention taken along line 1—1 shown in FIG. 2A.

FIG. 3A is a perspective view of an alternate embodiment of the present invention.

FIG. 3B is an enlarged partial perspective view of the alternate embodiment of FIG. 3A.

FIG. 4A is a perspective view of another embodiment of the present invention which provides an exercising handbag having a resilient body handgrip exerciser.

FIG. 4B is an enlarged perspective view of a squeezable handle grip of FIG. 4A.

FIG. 4C is a cross-sectional view of a squeezable handle grip consistent with the present invention taken along line 2—2 shown in FIG. 4B.

DETAILED DESCRIPTION OF THE PREFERRED EMBODIMENTS

Figure 2A:
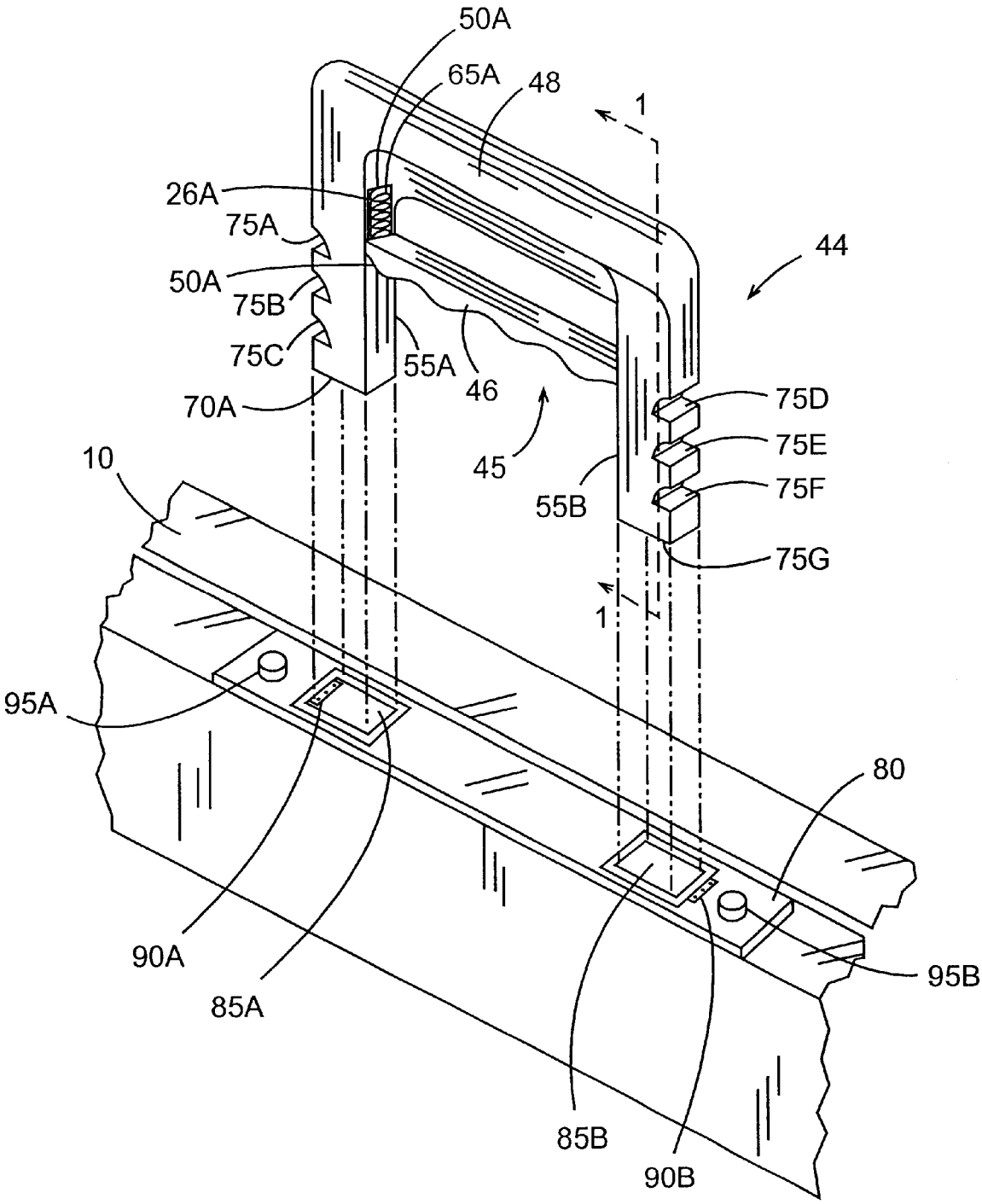
FIG. 2A is a partial perspective view of a preferred embodiment of the present invention.

It is to be understood for the purpose of this invention that the term bag, container or object is not only to include a handbag or briefcase which is typically carried in hand from one locale to another, but also the other types of hand-held objects which are commonly used as a means of carrying, holding, and/or manipulating devices by hand FIG. 1 is a perspective view of an embodiment of an exercising bag 5 consistent with the present invention. Referring to FIG. 1, there is shown a conventional briefcase 10 which includes a combined exercise hand-grip device 12. Combined exercise hand-grip device 12 generally comprises a handle 15 and a hand-grip exerciser 20 integrated with handle 15. As in most conventional briefcases, briefcase 10 generally comprises an upper half and a lower half, each having a rectangular face with a rectangular side wall coupled to periphery of the rectangular face. Further, a front portion of the side wall of the lower half of briefcase 10 includes a handle assembly 22 to receive handle 15 which is pivotally coupled thereto. Preferably, handle 15 is mounted upon handle assembly 22 utilizing generally known means for movably coupling to briefcase 10.

Handle 15 includes at least two spring receiving apertures 24A and 24B. Handgrip exerciser 20 comprises first and second springs 26A and 26B. Springs 26A and 26B, comprise respective first and second ends 30A through 30D extended longitudinally for coupling to handle 15. Handgrip exerciser 20 further comprises a handlebar 35 having at least two apertures 37A and 37B suitably aligned with the at least two spring receiving apertures 24A and 24B to receive for coupling the corresponding first and second ends 30A through 30D of the first and second springs 26A and 26B, respectively.

In an exemplary embodiment, handlebar 35 includes finger receiving portions 40 along the bottom surface thereof. According to one embodiment of the invention, for exercising one's hand, hand-grip exerciser 20 is adapted to couple with handle 15 of a container, such as a purse, a suitcase, computer satchel, work-out bag, attache case or any other similar item. Moreover, hand-grip exerciser 20 is adapted to receive replaceable springs 26A and 26B having a variety of strengths or spring rates in order to match physical capabilities of a user as different strength springs could be substituted within the device. Compressible tension interposed between handle 15 and handlebar 35 provides hand exercising capability while holding or carrying briefcase 10. Springs 26A and 26B could have spring rates selected to provide compressibility in a range from about 350 psi to about 700 psi.

Preferably, the present invention provides a handgrip assembly which combines a handgrip exerciser with a handle of a hand-carried or hand-held container. When such squeezable handgrip assembly is pressed in response to a user applied handgrip force, compression occurs against resistance of a compression device such as handgrip exerciser 20. Handgrip exerciser 20 enables the handgrip assembly to function as an exercising device for the hands, wrists and arms while such exercise occurs as the hand-carried or hand-held container may be manipulated by the user. Although handgrip exerciser 20 of the present invention could be utilized with any form, shape and size of handle 15, the hand exercise device functions in a relatively effective manner when integrated with a substantially straight handle 15 which is common within a variety of hand-carried or hand-held containers.

To utilize handle grip exerciser 20 for exercising hand, a user may grab or hold handle grip exerciser 20 to exert pressure or force onto the handlebar 35. In response to such user applied pressure onto the handlebar 35, handle grip exerciser 20 squeezes relative to handle 15 against a cumulative spring force of springs 26A and 26B. The user can selectively apply pressure or force to squeeze handle grip exerciser 20 and subsequently release the applied pressure or force. In such a repetitive manner, exercising of hand or handgrip can be advantageously performed.

FIG. 2A is a partial perspective view of a preferred embodiment of the present invention. FIG. 2B is a cross-sectional view of an integrated exercise handgrip device 44 taken along line 1—1 shown in FIG. 2A. With reference to FIGS. 2A and 2B, integrated exercise handgrip device 44 comprises an integrated handgrip exerciser 45 having an open-ended handlebar 46 preferably disposed in opposing recesses 50A and 50B for movably coupling to the inner sides of a U-shaped handle 48 having substantially parallel portions 55A and 55B.

Handlebar 46 is movable relative to handle 48, but is disposed in a close conforming manner therewith. Mounted within recesses 50A and 50B, and substantially occupying recesses 50A and 50B, are springs 26A and 26B, respectively. The open-ended handlebar 46 terminates in a pair of distal ends and is preferably constructed of a soft frictionally grabbing material such as a rubber or soft plastic mounted on a rigid rod 57 preferably constructed of a hard material such as a metal. The distal ends of the open-ended handlebar 46 are fixedly secured to handle 48. Extending longitudinally proximal to the distal ends of the open-ended handlebar 46 are abutments 60A and 60B which are disposed within respective spring chambers 65A and 65B. Preferably, abutments 60A and 60B clamp onto handle 48 in a tight fitting manner. Likewise, springs 26A and 26B are loaded within oppositely facing semi-cylindrically shaped spring chambers 65A and 65B for clamping onto handlebar 46 in a tight fitting manner. Alternatively, a spring assembly having a spring may be permanently located within each recess. Abutments 60A and 60B are substantially interlocked in respective recesses 50A and 50B for fixedly securing handlebar 46 and springs 26A and 26B. This prevents rotational movement of abutments 60A and 60B in respect to each other while permitting lineal movement of handlebar 46 relative to handle 48.

While exercising, linear movement of abutments 60A and 60B in response to compression and release of handlebar 46 causes compressing and expanding of the corresponding springs 26A and 26B. As a result, a convenient and effective solution is provided for concurrently exercising one's hand or handgrip while carrying or holding briefcase 10 in hand.

Of course, springs 26A and 26B of different strengths can be utilized and selectively replaced by a user. For example, by changing springs 26A and 26B to springs of higher or lower stiffness, handle grip exerciser 20 of FIG. 1 and/or integrated handle grip exerciser 45 of FIG. 2A can be custom tailored to the strength capabilities of an individual user so that full exercise benefits can be derived by the individual user. Alternatively, it should be appreciated that the handles 15 and/or 48 and/or handlebars 35 and 46 could be adapted to receive bolt fasteners having wings from orifices provided through handles 15 and/or 48 to the associated handlebars 35 and 46 for adjusting the strength of springs. Such bolt fasteners can preferably extend through springs 26A and 26B to be secured by integrally formed screw threads or a nut within handlebars 35 and/or 46.

Moreover, handles 15 and/or 48 could also be adapted to be detachable form briefcase 10 or a hand-carried/hand-held container such as a luggage bag or carry-on bag. For instance, a handle locking mechanism such as often employed in head rests of a motor vehicle seats may be adapted to be used with the present invention. More specifically, distal ends 70A and 70B of handle 48 could include one or more spatially distributed notches 75A through 75F, preferably disposed onto outer peripheral surfaces. Furthermore, a handle coupling assembly 80 can be mounted on the front portion of the lower half of briefcase 10. Handle coupling assembly 80 generally comprises handle receiving grooves 85A and 85B each having an associated integrally formed spring loaded flanges 90A and 90B. Distal ends 70A and 70B of handle 48 can be inserted in the corresponding handle receiving grooves 85A and 85B for coupling handle 48 to briefcase 10. Spring loaded flanges 90A and 90B latch onto a pair of opposing spatially distributed notches 75A through 75F. The interlocked handle 48 may be released by operating suitably configured levers 95A and 95B to move the respective spring loaded flanges 90A and 90B. In this manner, selective interlocking of the pair of opposing notches such as notches 75A and 75D or 75C and 75F with cooperating flanges 90A and 90B can provide multiple desired positions of handle 48 relative to the handle coupling assembly 80. As persons skilled in the art will recognize, any user operated lever-notch-flange type of interlocking mechanism can be readily employed for this purpose. Moreover, such interlocking mechanism could be readily devised in a variety of ways generally known to persons skilled in the art. For example, an interlocking mechanism could be adapted to co-operatively work with a conventional locking mechanism which is typically provided for securely locking a briefcase. In an exemplary embodiment, a detachable handle could only be removed when the briefcase is unlocked, thereby precluding any possibility of either losing or inadvertently popping out the handle while exercising one's hand.

FIG. 3A is a perspective view of an alternate embodiment of an exercising handbag 100 devised in accordance with the present invention. FIG. 3B is an enlarged partial perspective view of the alternate embodiment of FIG. 3A. With reference to FIGS. 3A and 3B, a joint exercise handgrip device 102 having a handle grip exerciser 105 is provided which includes a coil spring 110 including a top end 115A and a lower end 115B. Preferably, both the top and lower ends 115A and 115B are extended longitudinally such that top end 115A is coupled to a handbag handle 120 having an aperture 125 to receive top end 115A of coil spring 110. Handle grip exerciser 105 also includes a handgrip 130 with an aperture 135 to receive for coupling lower end 115B of coil spring 110. Briefcase 10 includes handle assembly 22 to receive handle 120. Preferably, handle 120 is mounted upon handle assembly 22 of briefcase 10 for movably coupling thereto.

Handgrip 130 generally comprises a finger receiving surface 135 along the bottom surface thereof. In operation, by closing and opening the hand to squeeze and release handgrip 30, a user would experience resistance to closing from coil spring 110. Consequently, providing desired exercise for hand, wrist and/or arm. Of course, coil spring 110 of different strengths can be utilized and selectively replaced to match the strength capabilities of an individual user so that full exercise benefits can be derived by the individual user.

FIG. 4A is a perspective view of another embodiment of the present invention which provides an exercising handbag 150 adapted to include a compressible exercise handgrip device 152 having a resilient body handgrip exerciser 155. FIG. 4B is an enlarged perspective view of a squeezable handle grip 160 of resilient body handgrip exerciser 155 depicted in FIG. 4A. FIG. 4C is a cross-sectional view of squeezable handle grip 160 taken along line 2—2 shown in FIG. 4B.

With reference to FIGS. 4A, 4B and 4C, resilient body handgrip exerciser 155 comprises a squeezable handle grip 160 for exercising hand, wrists and/or arm. Preferably, squeezable handle grip 160 includes finger receiving portions 165 along it's bottom surface. Additionally, squeezable handle grip 160 includes an inner compartment 170 that is sized and shaped to substantially fit over a briefcase handle 175 coupled to handle assembly 22 of briefcase 10. Inner compartment 170 includes a longitudinal slit 180 to couple squeezable handle grip 160 to briefcase handle 175 of briefcase 10. Preferably, squeezable handle grip 160 frictionally engages with briefcase handle 175 to provide a removable squeezable handle grip 160. Alternatively, squeezable handle grip 160 could be permanently bolted or glued to briefcase handle 175.

Of course, there are a variety of shapes, forms, and/or types of such handles that come with all sorts of hand-carried or hand-held bags, however, appropriate inner compartments could be readily devised accordingly. Therefore, it is to be understood that either the briefcase handle 175 or the inner compartment 170 should not be construed as being limited to only one set of dimensions and sizes. Thus, any preferred dimensions of the inner compartment 170 could be devised to accommodate such typical handles. Further, squeezable handle grip 160 of different strengths can be utilized and selectively replaced to match the strength capabilities of an individual user so that full exercise benefits can be derived by the individual user.

Squeezable handle grip 160 comprises material of a kind that is relatively squeezable for a user with an average handgrip. Obviously, squeezable handle grip 160 could be manufactured of relatively rigid or softer material as one desires. Such preferred materials include rubber, resilient polymeric material, or other materials that have suitable resiliency.

Figure 5:
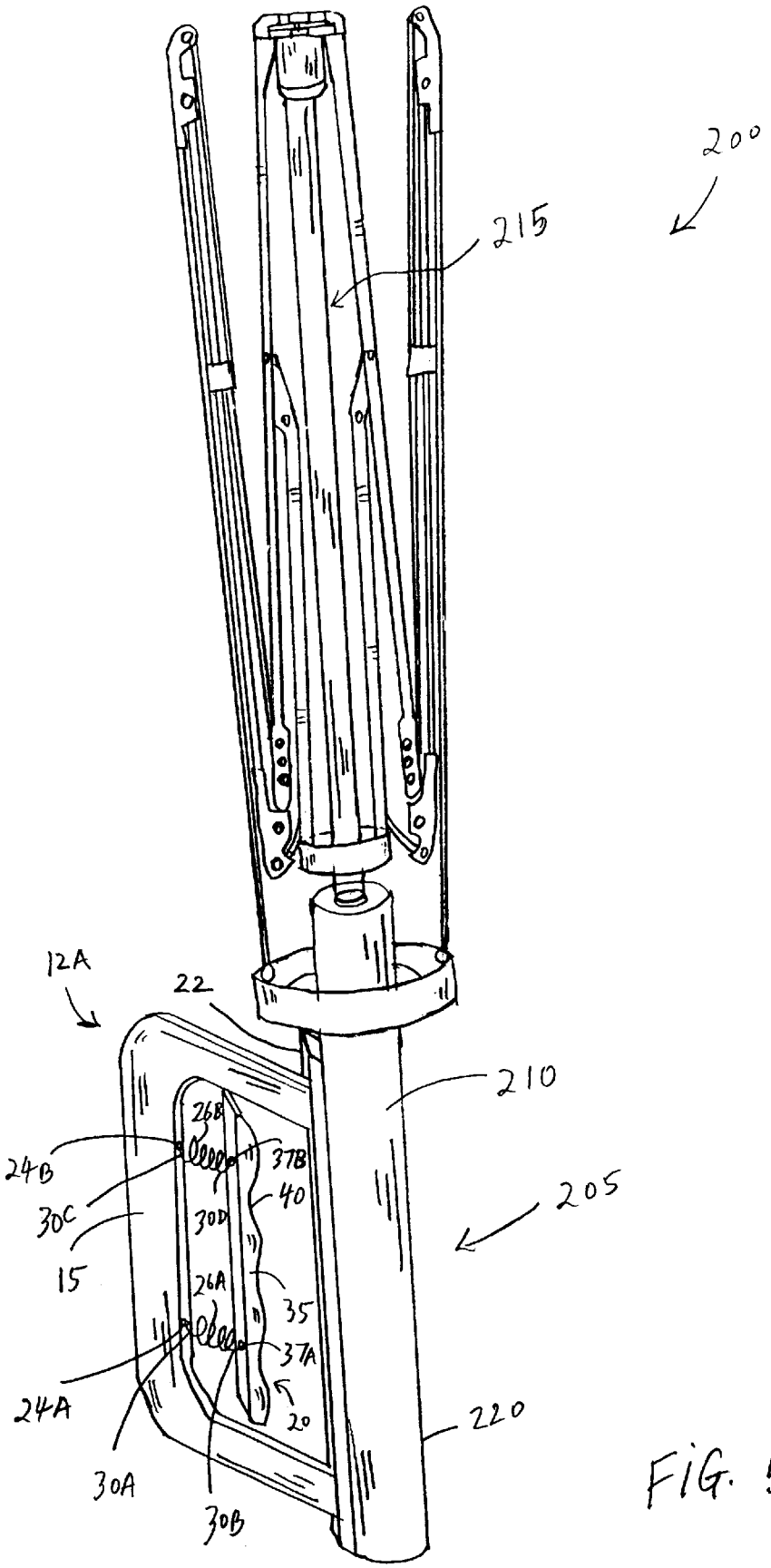
FIG. 5 is a perspective view of an umbrella having an exercise handle in accordance with the present invention.

FIG. 5 is a perspective view of an umbrella 200 comprising an umbrella exercise handle 205 in accordance with the present invention. Referring to FIG. 5, there is shown a conventional umbrella handle 210 coupled to a conventional umbrella frame 215. Umbrella exercise handle 205 includes an integrated exercise hand-grip device 12A identical to combined exercise hand-grip device 12 shown in FIG. 1. With reference to FIGS. 1 and 5, combined exercise handgrip device 12 generally comprises handle 15 and hand-grip exerciser 20 integrated with handle 15. As in most conventional umbrellas, umbrella handle 210 generally comprises a cylindrical face 220. Handle assembly 22 may be coupled to the periphery of cylindrical face 220 to receive handle 15 which is fixedly coupled thereto. Handle 15 may be mounted upon handle assembly 22 utilizing generally known means for coupling with umbrella handle 210.

As shown in FIG. 1, handle 15 may include at least two spring receiving apertures 24A and 24B. Handgrip exerciser 20 may comprise first and second springs 26A and 26B. Springs 26A and 26B, may comprise respective first and second ends 30A through 30D extended longitudinally for coupling to handle 15. Hand-grip exerciser 20 further may comprise handlebar 35 having at least two apertures 37A and 37B suitably aligned with the at least two spring receiving apertures 24A and 24B for coupling the corresponding first and second ends 30A through 30D of the first and second springs 26A and 26B, respectively.

In an exemplary embodiment, handlebar 35 may include finger receiving portions 40 along the bottom surface thereof. According to one embodiment of the invention, springs 26A and 26B may be replaceable. For example, springs 26A and 26B could be of different stiffness (spring rate) having a variety of strengths in order to match physical capabilities of a user as different strength springs could be substituted within the device. Compressible tension interposed between handle 15 and handlebar 35 generally provides hand exercising capability while holding or carrying umbrella 200.

In another alternate embodiment consistent with the present invention, a walker-cane incorporating a hand grip exerciser may be contemplated. For example, a combination may be devised of a hand grip exerciser with a handle of a walker-cane which typically provides support while walking.

Although the present invention and its advantages have been described in detail, it should be understood that various changes, substitutions and alterations can be made to the embodiments described herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

I claim:

1. An exercising handbag comprising:

a container member;

a handle coupled to the container member; and a handgrip exerciser integral with the handle, wherein the handle comprises:

first and second apertures, and wherein the handgrip exerciser comprises:

first and second springs, each spring having first and second ends extended longitudinally for coupling the first ends of the first and second springs to the handle through the first and second apertures; and a handlebar comprising third and fourth apertures for coupling the second ends of the first and second springs, respectively.

2. The exercising handbag of claim 1, wherein the handlebar comprises finger receiving portions along the bottom surface thereof.

3. The exercising handbag of claim 1, wherein the first and second springs are replaceable, each spring has a selectable strength of spring rates including a first and second spring rate, wherein the first spring rate is lower in strength than the second spring rate.

4. An exercising handbag comprising:

a container member;

a handle coupled to the container member; and a handgrip exerciser integral with the handle, wherein the handgrip exerciser comprises:

a coil spring having first and second ends extended longitudinally, the first end being coupled to the handle through a first aperture in the handle; and a handlebar comprising a second aperture for coupling the second end of the coil spring.

5. The exercising handbag of claim 4, wherein the handlebar comprises finger receiving portions along the bottom surface thereof.

6. An exercising handbag comprising:

a container member;

a handle coupled to the container member, wherein the handle is detachable from the container member; and a handgrip exerciser integral with the handle.

7. A handle exercise grip attachable to a container member, comprising:

a removable handle; and a hand exercise device including a handlebar, the hand exercise device integrated with the removable handle, wherein the hand exercise device comprises:

a compression device for interposing compressible tension between the removable handle and the handlebar.

8. The handle exercise grip of claim 7, wherein the hand exercise device is provided for exercising a hand while holding the removable handle.

9. The handle exercise grip of claim 7, wherein the removable handle is configured for manipulating by hand and the hand exercise device is squeezable for exercising a hand while concurrently operating the container member.

10. The handle exercise grip of claim 7, wherein the compression device comprises:

first and second springs with each spring having associated first and second spring chambers extended longitudinally for receiving the first and second springs within the removable handle through first and second recesses therein; and an elongated handlebar comprising first and second abutments for coupling to the removable handle through the first and second recesses.

11. The handle exercise grip of claim 10, wherein the first and second springs each having a selectable strength of spring rates including a first and second spring rate, wherein the first spring rate is lower in strength than the second spring rate.

12. An exercising handbag comprising:

a container member;

a handle coupled to the container member, wherein the handle is detachable from the container member; and a handgrip exerciser integral with the handle.

13. An exercising handbag comprising:

a container member;

a handle coupled to the container member; and a handgrip exerciser integral with the handle;

wherein the handle comprises first and second apertures, and wherein the handgrip exerciser comprises:

first and second springs, each spring having first and second ends extended longitudinally for coupling the first ends of the first and second springs to the handle through the first and second apertures; and a handlebar comprising third and fourth apertures for coupling the second ends of the first and second springs, respectively.

14. The exercising handbag of claim 12, wherein the handlebar comprises finger receiving portions along the bottom surface thereof.

15. The exercising handbag of claim 12, wherein the first and second springs are replaceable, each spring has a selectable strength of spring rates including a first and second spring rate, wherein the first spring rate is lower in strength than the second spring rate.

16. An exercising handbag comprising:

a container member;

a handle coupled to the container member;

a handgrip exerciser integral with the handle;

a coil spring having first and second ends extended longitudinally, the first end being coupled to the handle through a first aperture in the handle; and a handlebar comprising a second aperture for coupling the second end of the coil spring.

17. The exercising handbag of claim 16, wherein the handlebar comprises finger receiving portions along the bottom surface thereof.

18. The exercising handbag of claim 16, wherein the coil spring has a selectable strength of spring rates including a first and second spring rate, wherein the first spring rate is lower in strength than the second spring rate.

19. A handle exercise grip attachable to a container member, comprising:

a removable handle; and a hand exercise device including a handlebar, the hand exercise device integrated with the removable handle and including a compression device for interposing compressible tension between the removable handle and the handlebar.

20. The handle exercise grip of claim 19, wherein the hand exercise device is provided for exercising a hand while holding the removable handle.

21. The handle exercise grip of claim 19, wherein the removable handle is configured for manipulating by hand and the hand exercise device is squeezable for exercising a hand while concurrently operating the container member.

22. The handle exercise grip of claim 19, wherein the compression device comprises:

first and second springs with each spring having associated first and second spring chambers extended longitudinally for receiving the first and second springs within the removable handle through first and second recesses therein; and an elongated handlebar comprising first and second abutments for coupling to the removable handle through the first and second recesses.

23. The handle exercise grip of claim 22, wherein the first and second springs each having a selectable strength of spring rates including a first and second spring rate, wherein the first spring rate is lower in strength than the second spring rate.

* * * * *